US010184350B2

(12) United States Patent
Hall

(10) Patent No.: US 10,184,350 B2
(45) Date of Patent: Jan. 22, 2019

(54) UNISON RING SELF-CENTRALIZERS AND METHOD OF CENTRALIZING

(71) Applicant: Rolls-Royce North American Technologies, Inc., Indianapolis, IN (US)

(72) Inventor: Christopher Hall, Indianapolis, IN (US)

(73) Assignee: Rolls-Royce North American Technologies, Inc., Indianapolis, IN (US)

( * ) Notice: Subject to any disclaimer, the term of this patent is extended or adjusted under 35 U.S.C. 154(b) by 609 days.

(21) Appl. No.: 14/867,951

(22) Filed: Sep. 28, 2015

(65) Prior Publication Data

US 2016/0201504 A1 Jul. 14, 2016

Related U.S. Application Data

(60) Provisional application No. 62/056,931, filed on Sep. 29, 2014.

(51) Int. Cl.

| | |
|---|---|
| ***F01D 25/28*** | (2006.01) |
| ***F01D 21/08*** | (2006.01) |
| ***F01D 9/04*** | (2006.01) |
| ***F01D 25/24*** | (2006.01) |

(Continued)

(52) U.S. Cl.

CPC ..... *F01D 21/08* (2013.01); *F01D 9/041* (2013.01); *F01D 17/162* (2013.01); *F01D 25/246* (2013.01); *F04D 29/563* (2013.01); *F05D 2220/32* (2013.01); *F05D 2230/60* (2013.01); *F05D 2230/642* (2013.01); *F05D 2260/30* (2013.01)

(58) Field of Classification Search

CPC ..... F01D 17/167

See application file for complete search history.

(56) References Cited

U.S. PATENT DOCUMENTS

| | | | |
|---|---|---|---|
| 3,030,072 | A | 4/1962 | Boyd |
| 3,074,689 | A | 1/1963 | Chapman |
| 3,736,070 | A | 5/1973 | Moskowitz et al. |

(Continued)

FOREIGN PATENT DOCUMENTS

| | | | |
|---|---|---|---|
| EP | 1010918 | A2 | 6/2000 |

OTHER PUBLICATIONS

European Search Report, dated Feb. 16, 2016, 3 pages.

*Primary Examiner* — Logan Kraft
*Assistant Examiner* — Jason Fountain
(74) *Attorney, Agent, or Firm* — Fishman Stewart PLLC

(57) ABSTRACT

A centralizing assembly for an engine having a plurality or rotatable vanes is provided including an engine casing and at least one unison ring disposed concentrically there about. A spacing gap is formed between the unison ring and the engine casing and is variable between a maximum spacing gap and a minimum spacing gap in response to thermal expansion of the engine casing. A centralizer element includes a plunger element movably mounted to unison ring and spanning the spacing gap. At least one conical spring washer is mounted to the plunger element and exerts a centralizing force through the plunger element onto the engine casing. The at least one conical spring washer maintains the centralizing force between the maximum spacing gap and the minimum spacing gap.

18 Claims, 7 Drawing Sheets

(51) Int. Cl.
*F01D 17/16* (2006.01)
*F04D 29/56* (2006.01)

(56) References Cited

U.S. PATENT DOCUMENTS

| | | | | |
|---|---|---|---|---|
| 4,035,101 | A | 7/1977 | Glenn | |
| 4,050,844 | A | 9/1977 | Miller et al. | |
| 4,373,859 | A | 2/1983 | Thebert | |
| 4,773,821 | A | 9/1988 | Gonthier et al. | |
| 4,826,399 | A | 5/1989 | Perez | |
| 4,925,364 | A | 5/1990 | Das | |
| 5,044,781 | A * | 9/1991 | Werner | F16C 27/04 384/99 |
| 5,054,997 | A | 10/1991 | Corsmeier et al. | |
| 5,104,287 | A | 4/1992 | Ciokajlo | |
| 6,092,984 | A * | 7/2000 | Bouyer | F16F 15/04 415/119 |
| 6,968,702 | B2 * | 11/2005 | Child | F01D 9/042 29/889.22 |
| 7,244,098 | B2 * | 7/2007 | Bromann | F01D 17/162 415/160 |
| 8,092,157 | B2 | 1/2012 | McCaffrey | |
| 8,123,472 | B2 | 2/2012 | Redgwell | |
| 8,240,983 | B2 | 8/2012 | Suljak, Jr. et al. | |
| 9,091,322 | B2 * | 7/2015 | Wang | F16F 15/04 |
| 2006/0193720 | A1 | 8/2006 | Bromann | |

* cited by examiner

UNISON RING SELF-CENTRALIZERS AND METHOD OF CENTRALIZING

CROSS-REFERENCE TO RELATED APPLICATION

This application claims priority to U.S. Provisional Patent Application No. 62/056,931 filed Sep. 29, 2014, the contents of which are hereby incorporated in its entirety.

This disclosure was made with government support under FA8650-07-C-2803 awarded by the Department of Defense. The government has certain rights in the disclosure.

FIELD OF TECHNOLOGY

An improved integrated design and method of centralizing unison rings used in gas turbine engines is provided. More particularly, a design and method to accommodate for thermal variations between components such as the engine casing and unison ring is provided.

BACKGROUND

Gas turbine engines commonly utilize variable vane assemblies to control the flow of a fluid, usually air or combustion products, through various compression and expansion stages of the engine. Typically, they comprise Inlet Guide Vanes (IGVs) or Stator Vanes (SVs) disposed within the flow passages of the engine adjacent to rotor blade assemblies, usually in the compressor stages or fans of the engine although variable stator vanes may also be used in power turbines. Air passing between the vanes is directed at an appropriate angle of incidence for the succeeding rotating blades.

Each vane in a variable vane assembly is rotatably mounted about its longitudinal axis within the flow path of a compressor or turbine. The vane is connected at its radially outer end to a lever which, in turn, is pivotally connected to a unison ring. The unison ring is mounted on carriers so that it is rotatable about its central axis, which coincides with the engine axis.

The unison ring is rotated by means of one or more actuators, acting on the ring. The actuators exert a tangential load on the unison ring causing the ring to rotate about its central axis. Rotation of the unison ring actuates each of the levers causing the vanes to rotate, in unison, about their respective longitudinal axes. The vanes can thus be adjusted in order to control the flow conditions within the respective compressor or turbine stages.

It is known that when a unison ring is not properly centralized around the engine casing, it may impart vane angle errors within the variable vane assembly. Unison ring decentralization may be caused by gravity, assembly loads, the number of actuators, warpage, or a variety of operating conditions. In addition, the engine casing often experiences thermal expansion during operation. This thermal expansion can vary the gap between the unison ring and the engine casing. Attempts to properly center the unison ring on the engine casing must accommodate the varying tolerances caused by such thermal expansion.

Overcoming these concerns would be helpful, could improve vane angle accuracy, and could minimize variations caused by thermal expansion.

BRIEF DESCRIPTION OF THE DRAWINGS

While the claims are not limited to a specific illustration, an appreciation of the various aspects is best gained through a discussion of various examples thereof. Referring now to the drawings, exemplary illustrations are shown in detail. Although the drawings represent the illustrations, the drawings are not necessarily to scale and certain features may be exaggerated to better illustrate and explain an innovative aspect of an example. Further, the exemplary illustrations described herein are not intended to be exhaustive or otherwise limiting or restricted to the precise form and configuration shown in the drawings and disclosed in the following detailed description. Exemplary illustrations are described in detail by referring to the drawings as follows:

DETAILED DESCRIPTION

A centralizing assembly is described herein and is shown in the attached drawings. A gas turbine engine assembly utilizes a centralizing assembly to maintain the unison ring in proper orientation around the engine casing. The present disclosure describes such a system. In addition, the present disclosures describes a method of centralizing a unison ring around an engine casing that is adapted to accommodate thermal expansion of the engine casing.

Figure 1:
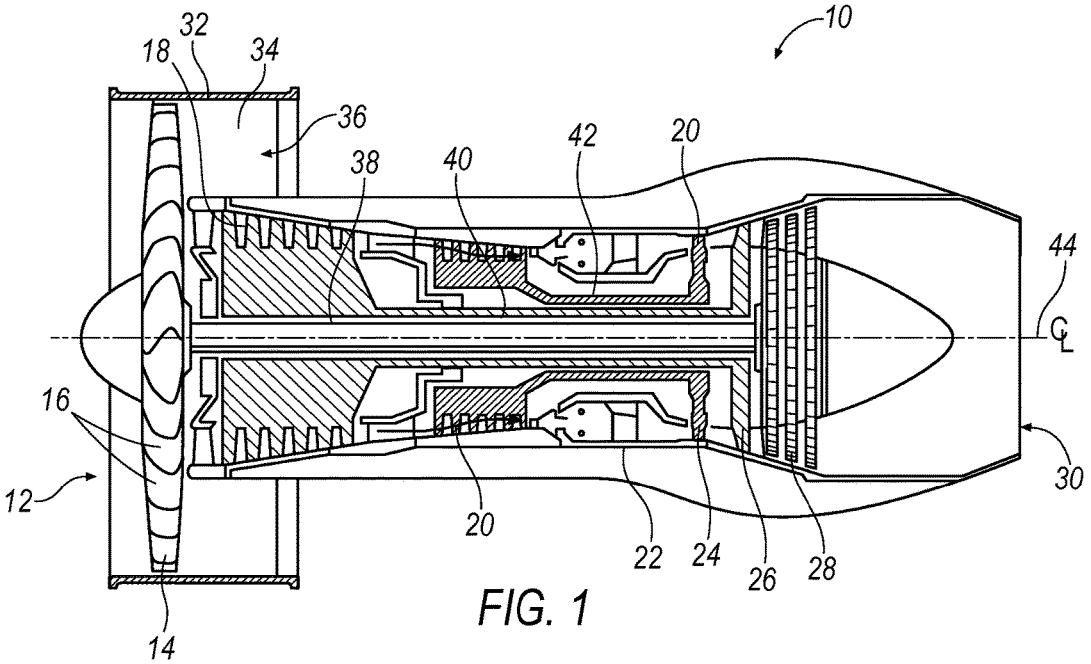
FIG. 1 is an illustration of a gas turbine engine assembly according to one example.

FIG. 1 illustrates a gas turbine engine assembly 10 in accordance with one exemplary example. The exemplary engine assembly 10 includes an air intake 12, a propulsive fan 14 having a plurality of fan blades 16, an intermediate pressure compressor 18, a high pressure compressor 20, a combustor 22, a high-pressure turbine 24, an intermediate pressure turbine 26, a low-pressure turbine 28 and a core exhaust nozzle 30. A nacelle 32 surrounds the engine 10 and defines the intake 12, a bypass duct 34 and a bypass exhaust nozzle 36. The engine has a principal axis of rotation 44.

Air entering the intake 12 is accelerated by the fan 14 to produce a bypass flow and a core flow. The bypass flow travels down the bypass duct 34 and exits the bypass exhaust nozzle 36 to provide the majority of the propulsive thrust produced by the engine 10. The core flow enters in axial flow series the intermediate pressure compressor 18, high pressure compressor 20 and the combustor 22, where fuel is added to the compressed air and the mixture burnt. The hot combustion products expand through and drive the high, intermediate and low-pressure turbines 24, 26, 28 before being exhausted through the nozzle 30 to provide additional propulsive thrust. The high, intermediate and low-pressure turbines 24, 26, 28 respectively drive the high and intermediate pressure compressors 20, 18 and the fan 14 by interconnecting shafts 38, 40, 42.

Figure 2:
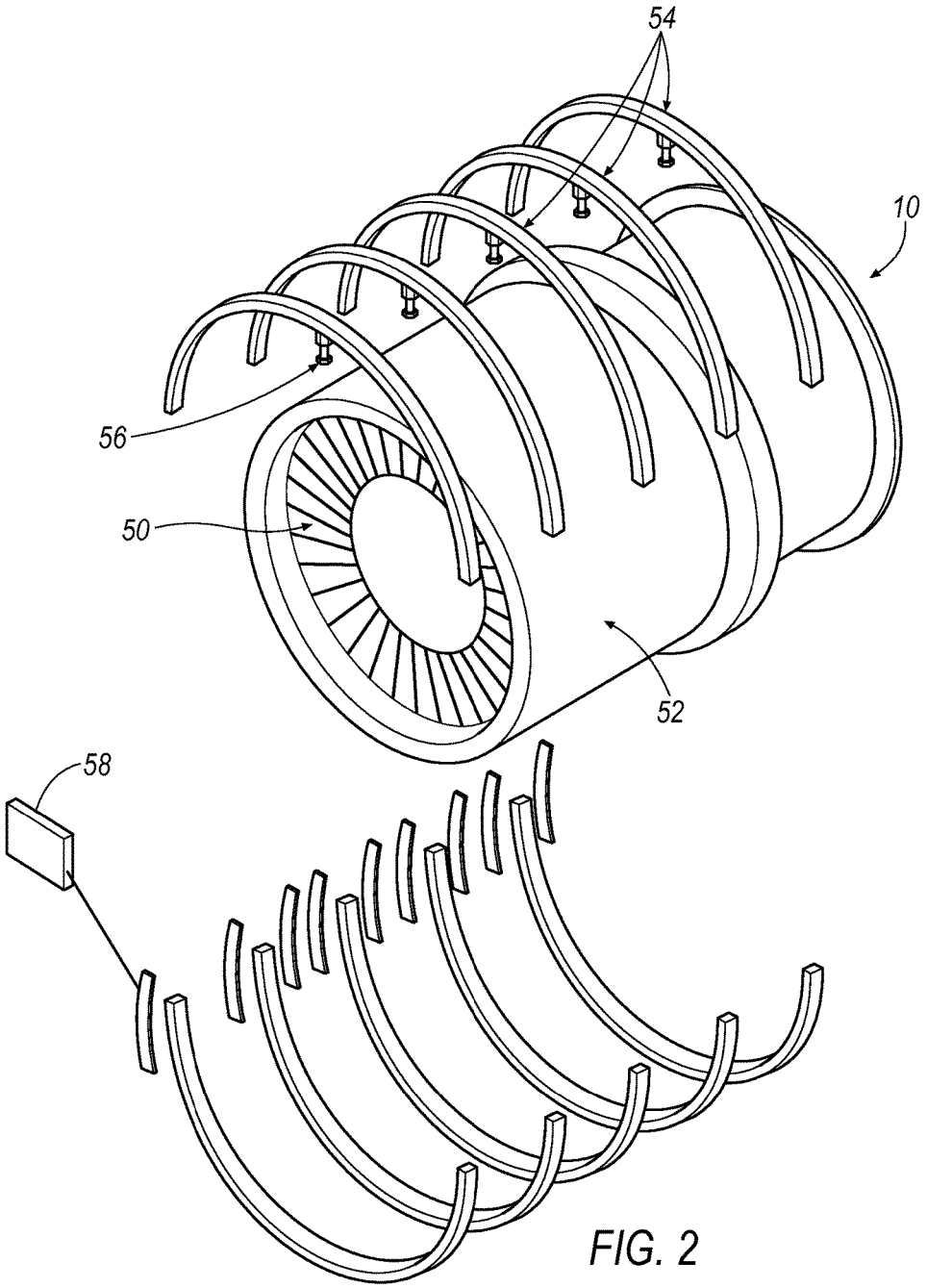
FIG. 2 is an exploded view illustration of a portion of the gas turbine engine assembly illustrated in FIG. 2.

The engine assembly 10 includes variable vane arrangement in various locations throughout the assembly to control the air flow passing through the engine core and to improve the performance of the engine. FIG. 2 is an exploded view illustration of one such portion of the engine assembly 10. A plurality of variable vanes 50 are mounted within an engine casing 52 and are utilized to control the flow of air through the engine casing 52. The angle of the plurality of variable vanes 50 is controlled through the use of unison rings 54 positioned concentrically around the engine casing 52. The unison rings 54 are in communication with the variable vanes 50 through a linkage system 56 that varies the angles of the variable vanes 50 when the unison rings 54 are rotated about the engine casing 52. Actuators 58 are utilized to rotate the unison rings 54 and thereby control the angle of the variable vanes 50.

Figure 3:
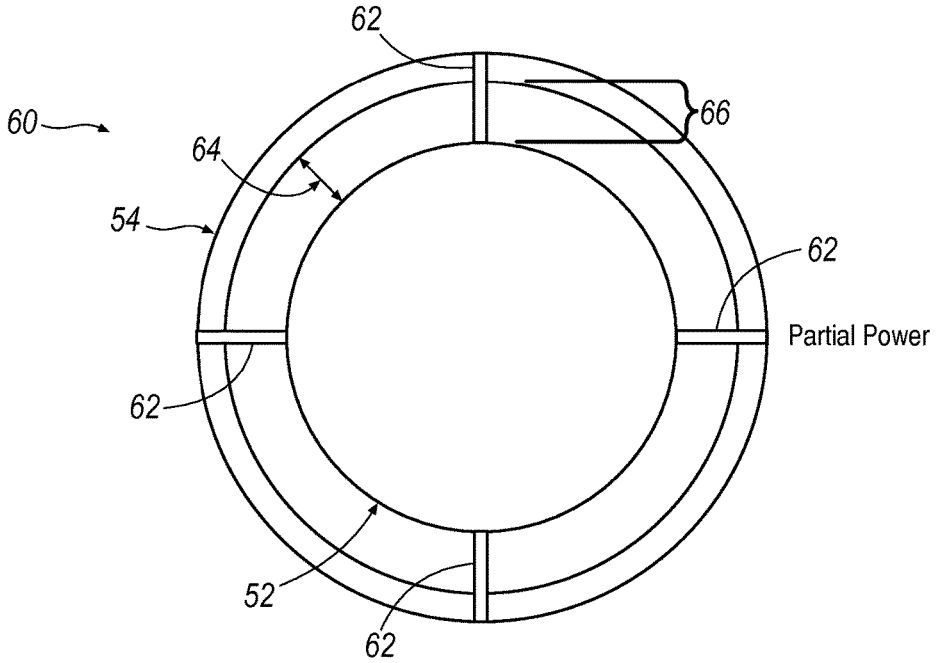
FIG. 3 is an illustration of centralizing assembly for use in the gas turbine engine assembly illustrated in FIG. 1, the centralization assembly illustrated is in a partial operation or cold condition.

The angle of the variable vanes 50 may be affected if the unison ring 54 is not properly centered on the engine casing 52. Deviations of a unison ring 54 away from center may impart vane angle errors to some of the variable vanes 50. Maintaining the unison ring 54 centered on the engine casing 52 is useful not only on production engines, but is important for engine development and vane angle optimization testing purposes. Therefore, a centralizing assembly 60, as shown in FIG. 3, is utilized to maintain the orientation of the unison ring 54 centered on the engine casing 52. The centralizing assembly 60 includes a plurality of centralizer elements 62 mounted to and positioned around the circumference of the unison ring 54. In one exemplary example, at least three centralizer elements 62 are utilized and in another example at least four are utilized. The centralizer elements 62 exert a force on the engine casing 52 to maintain the position of the unison ring 54 but are movable about the surface of the engine casing 52 to allow for relative rotation of the unison ring 54.

Figure 4:
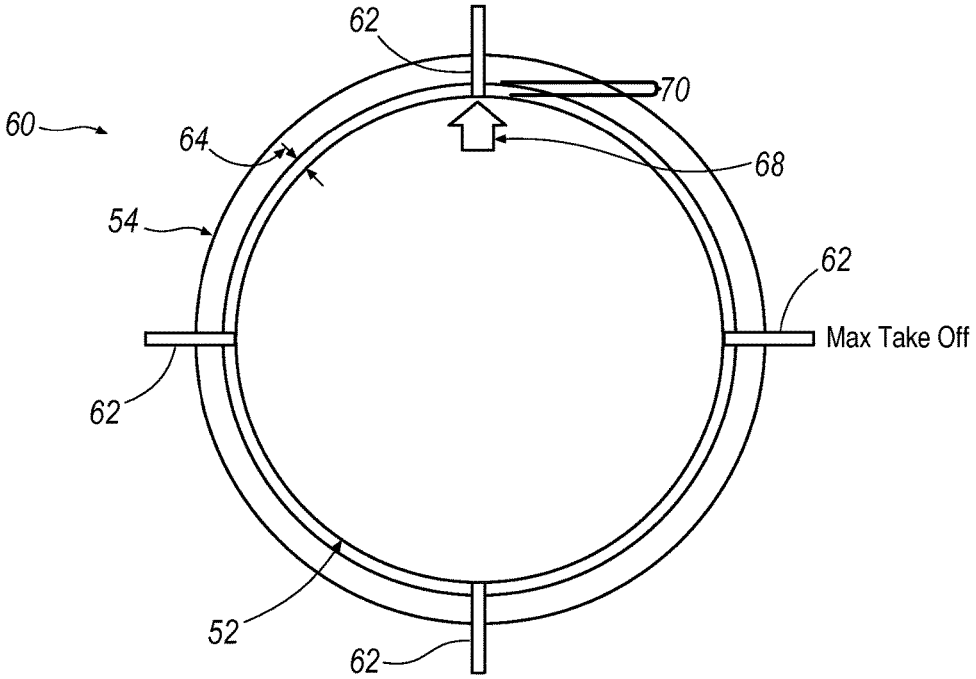
FIG. 4 is an illustration of a centralizing assembly for use in the gas turbine engine assembly illustrated in FIG. 1, the centralization assembly illustrated is in a full operation or hot condition.

A spacing gap 64 is present between the unison ring 54 and the engine casing 52. The spacing gap 64 may vary due to thermal expansion of the engine casing 52 during engine operation. During startup or partial power operations as illustrated in FIG. 3, the spacing gap 64 comprises a maximum spacing gap 66 as the engine casing 52 experiences minimal thermal expansion. However, during maximum take off or high loading, the engine casing 52 experiences thermal expansion 68 and the spacing gap 64 shrinks to a minimum spacing gap 70 as illustrated in FIG. 4. The amount of thermal expansion 68 is dictated by the thermal expansion characteristics of the engine casing 52. The acceptable limits on the spacing gap 66 are dictated by the dimensional tolerance characteristics of the unison ring 54 and associated mechanical components.

Current centralizer designs utilize a cold build gap between a centralizer and the engine casing to account for the thermal expansion 68 of the engine casing 52. This is to allow the thermal expansion 68 to increase to the minimum spacing gap 70 without biding the unison ring 54 to the engine casing 52. Such a binding could result in a loss of control of the vane angles. Unfortunately, this means that current centralizer designs must leave a gap between any centralizer and the engine casing 52 during partial power in order to prevent binding at maximum power. This presents issues at partial power wherein the cold gap can allow the unison ring 54 to float and move off center changing vane angles and reducing the surge margin. The centralizing assembly 60 disclosed, however, does not require a cold build gap and does not float at partial power.

Figure 5:
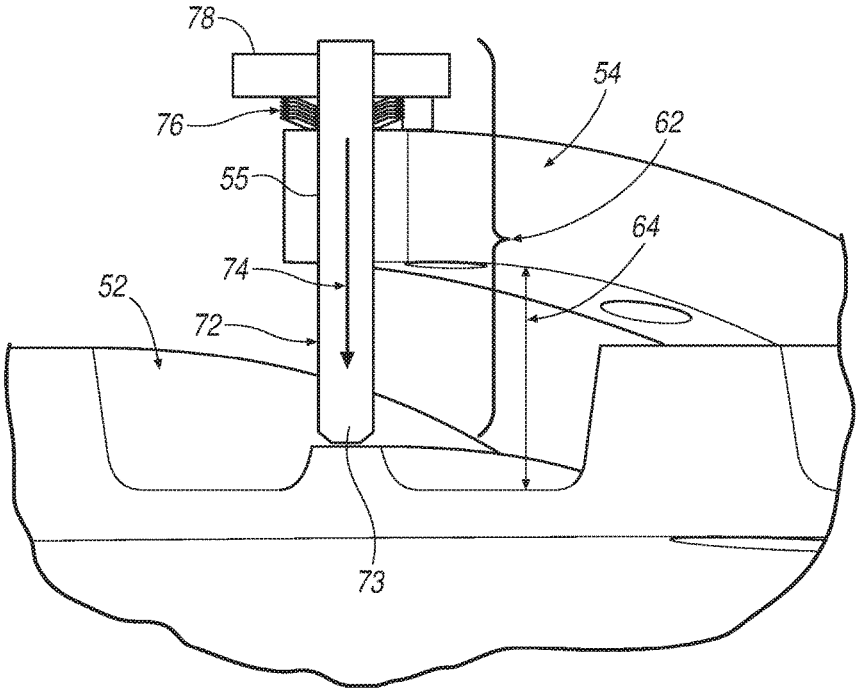
FIG. 5 is a detailed illustration of the centralizing assembly illustrated in FIGS. 1 and 2, the centralizing assembly having conical spring washers stacked in a parallel configuration.

A detailed view of the centralizing assembly 60 is illustrated in FIG. 5. The Figure depicts a centralizer assembly 60 in accordance with one exemplary example. The centralizer element 62 includes a plunger element 72 movably/slidably mounted to the unison ring 54, via a bore 55, and spanning the spacing gap 64 between the unison ring 54 and the engine casing 52. The plunger element 72 is configured to exert a centralizing force 74 onto the engine casing 52 to maintain position of the unison ring 54. The plunger element 72 may include a plunger tip 73 configured of a material suitable to facilitate a sliding engagement with the engine casing 52. The amount of the centralizing force 74 is generated and controlled through the use of a plurality of biasing elements, i.e. springs such as conical spring washers 76, mounted to the plunger element 72 and generating a force through the plunger element 72 and onto the engine casing 52. In one exemplary example, the conical spring washers 76 comprise Bellville washers. Conical springs allow for the generation of centralizing forces 74 that are not capable of being provided by standard coil springs of suitable size. Additionally, conical spring washers 76 may be stacked to customize the centralizing force 74 at each plunger element 72 individually. This may be accomplished through the stacking of multiple conical spring washers 76 of the same spring constant k or by stacking multiple conical spring washers 76 of varying spring constants k.

Figure 6:
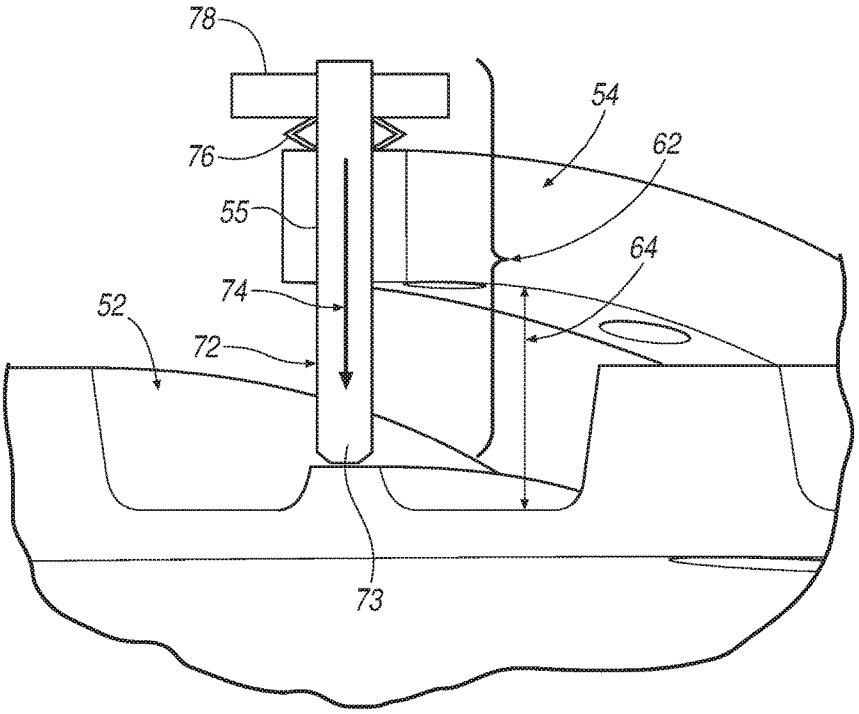
FIG. 6 is a detailed illustration of the centralizing assembly illustrated in FIGS. 1 and 2, the centralizing assembly having conical spring washers stacked in a series configuration.
Figure 7:
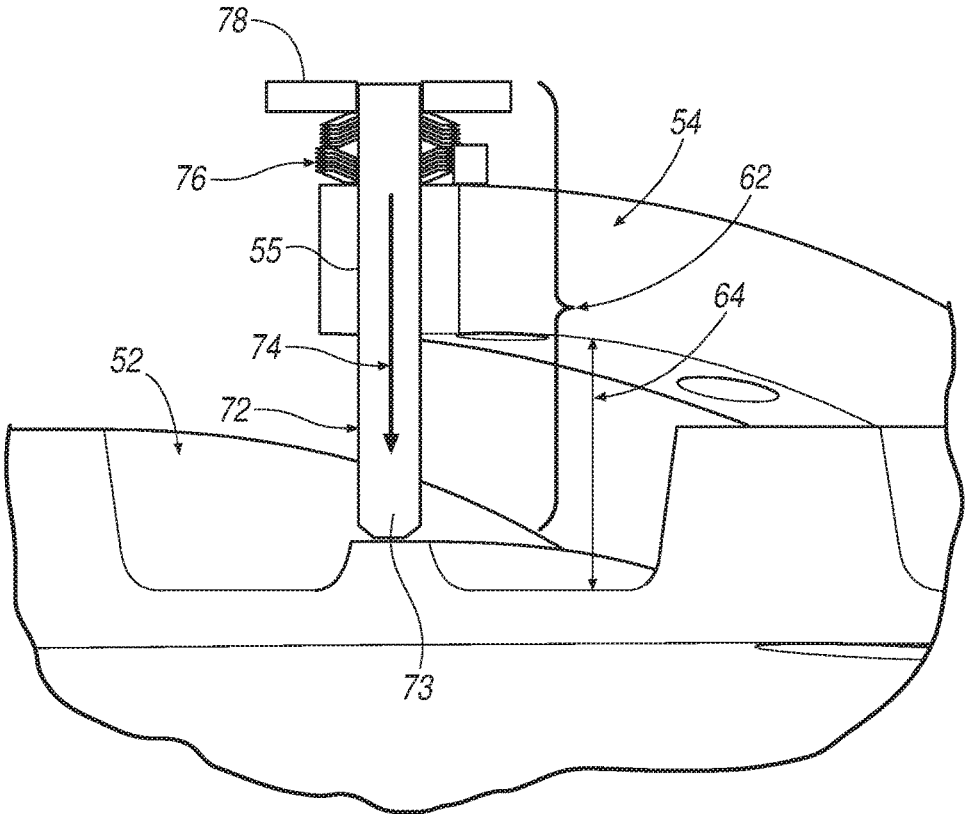
FIG. 7 is a detailed illustration of the centralizing assembly illustrated in FIGS. 1 and 2, the centralizing assembly having conical spring washers stacked in both parallel and series configurations.

The conical spring washers 76 may be stacked in a variety of fashions. In FIG. 5 the conical spring washers 76 are stacked in a parallel configuration. They are mounted to the plunger element 72 and fixed in relation to the unison ring 54 by a retaining element 78, such as a nut, as would be well understood. Retaining element 78 may be mounted to the unison ring 54 or another structure. Stacking the conical spring washers 76 in parallel increases the total spring constant and therefore provides precise control over the centralizing force 74. The conical spring washers 76 may also be stacked in series as illustrated in FIG. 6. Stacking the spring washers 76 in series can allow for greater deflection range of the plunger element 72. It is further contemplated that the conical spring washers 76 may be stacked in both parallel and series together, as shown in FIG. 7, in order to tailor the centralizing force 74 as well as the deflection range of the plunger element 72. In this fashion, each centralizer element 62 may be precisely configured such the plunger element 72 maintains the centralizing force 74 on the engine casing 52 while simultaneously allowing travel between the maximum spacing gap 66 and the minimum spacing gap 70. By varying the number and orientation of the conical spring washers 76 at each location around the unison ring 54, the orientation of the unison ring 54 can be precisely controlled both at partial power r as well as maximum take off.

Figure 8:
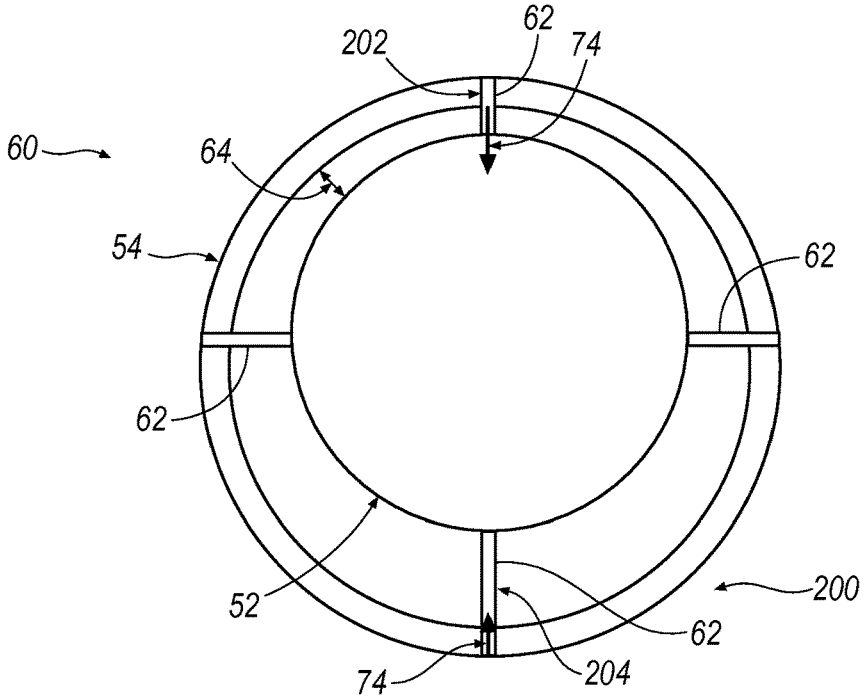
FIG. 8 is an illustration of a centralization assembly including a unison ring with asymmetrical characteristics.
Figure 9:
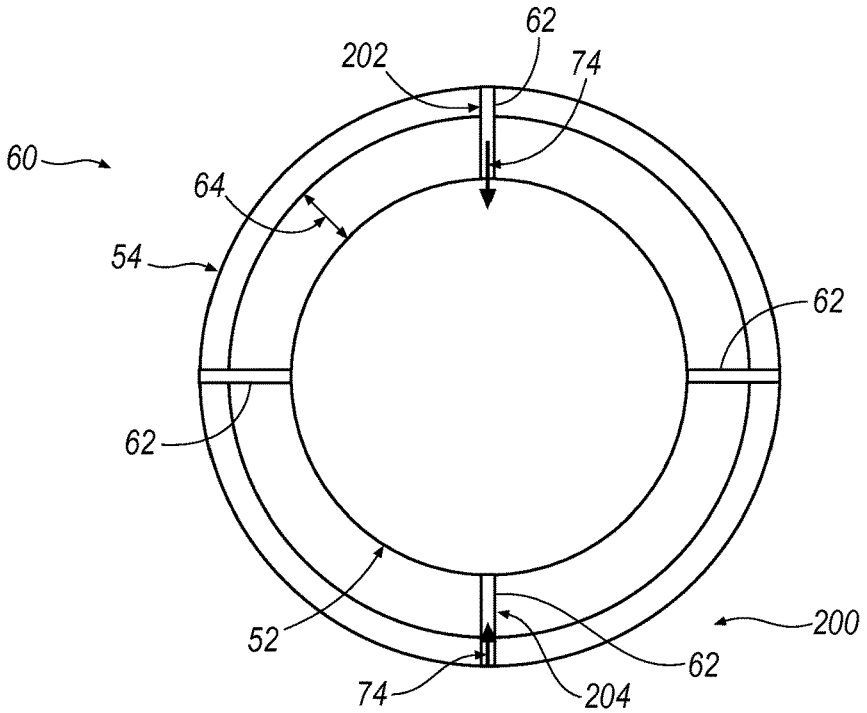
FIG. 9 is an illustration of the centralization assembly shown in FIG. 8 after tuning of the centralization assembly.

The described centralizing assembly 60 can be implemented in a variety of novel fashions due to its flexibility and customization at teach centralizer element 62 location. In one exemplary example shown in FIG. 8, the assembly 60 may be implemented on unison rings 54 that either have or have developed asymmetrical characteristics. The unison ring 54 is illustrated in a grossly asymmetrical configuration for illustrative purposes only. Asymmetrical characteristics may develop due to design considerations, gravity, or distortion during operation. An advantage of the disclosed centralizing assembly 60 is that it may be implemented or modified at any time without disassembly of the engine structure. In the illustrated example, the unison ring has become distorted in the lower regions 200. The upper centralizer 202 may be stacked with conical spring washers in a configuration that provides increased centralizing force 74 and reduced deflection range. The lower centralizer 204 may be stacked with conical spring washers in a configuration that provides a reduced centralizing force 74 and an increased deflection range. This can be used to bring the unison ring 54 back into a centralized configuration as shown in FIG. 9.

Figure 10:
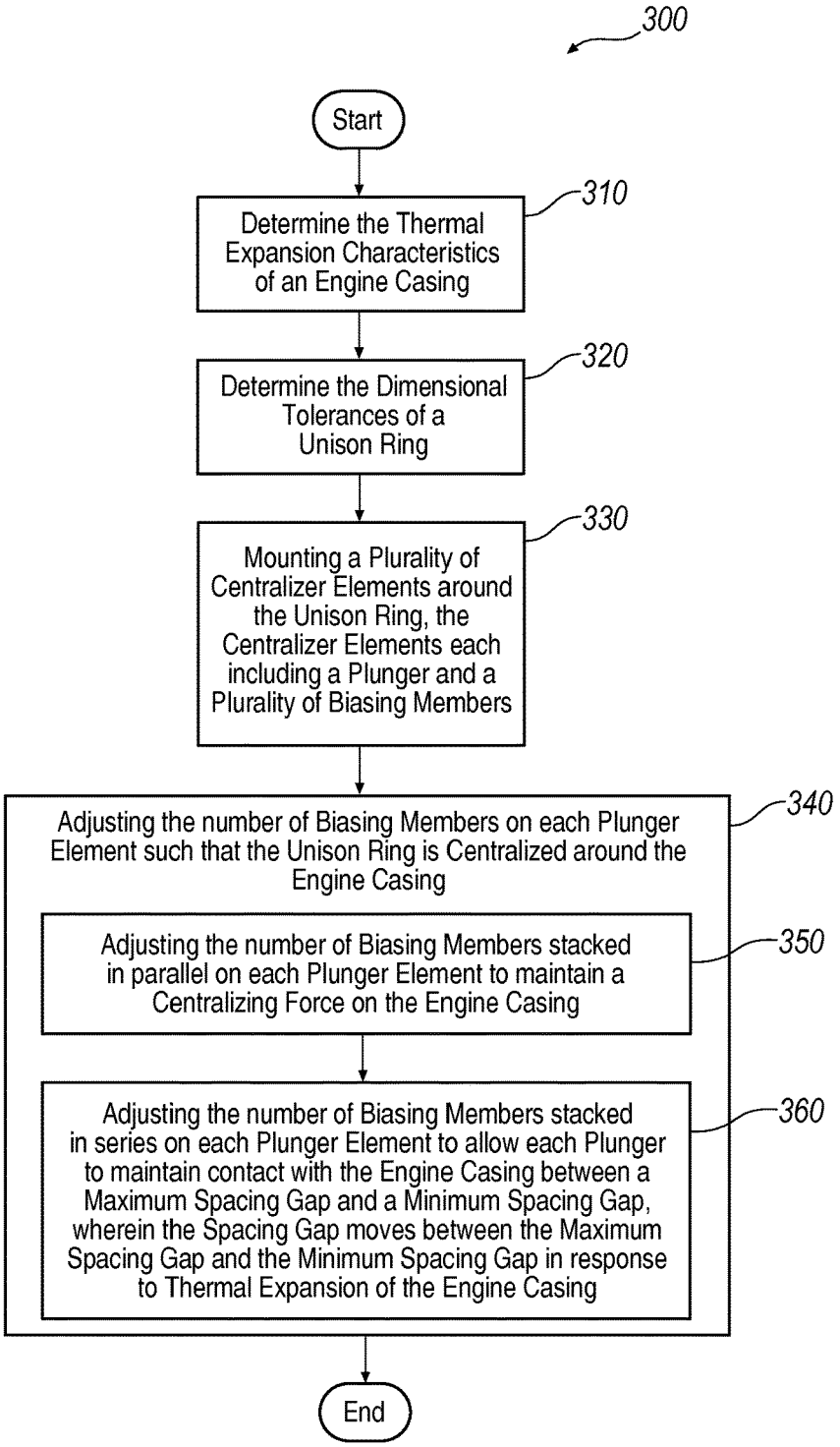
FIG. 10 is a flow chart illustration showing a method of centralizing a unison ring around an engine casing according to one example.

Finally, the centralizing assembly 60 can be implemented to tailor the centralizing needs of specific engine designs or even specific engines at times during their operation lifespans. A method 300 for centralizing a unison ring around an engine casing is illustrated in FIG. 10. The method 300 includes determining the thermal expansion characteristics of an engine casing 310. This may be accomplished by design or experimentally. The thermal expansion characteristics include both expansion distances as well as the expansion forces generated as the engine transitions between its coldest state and its hottest state during maximum operations. The method 300 also includes determining the dimensional tolerance characteristics of a unison ring positioned around the engine casing 320. This is contemplated to include the allowable reduction in the spacing gap 64 prior to the system experiencing binding between the unison ring 54 and the engine casing 52. This can also include the allowable reduction in the spacing gap 64 prior to interference arising with linkages or other structures.

The method then contemplates mounting a plurality of centralizer elements around the unison ring, each centralizer element comprising a plunger element movably mounted to the unison ring and a plurality of conical spring washers mounted to the plunger element, wherein each plunger element spans a spacing gap between the unison ring and the engine casing and exerts a centralizing force on the engine casing 330. The locations of these centralizer elements are preferably symmetrically distributed around the unison ring. The method then individually adjusting the number of conical spring washers on each plunger element to accommodate the thermal expansion characteristics and the dimensional tolerance characteristics such that the unison ring is centralized around the engine casing between a maximum spacing gap and a minimum spacing gap 340. This allows precise control of centralization forces and deflections that directly correspond to the individually determined characteristics of a specific gas turbine engine. As a result an improvement in both vane accuracy as well as thermal expansion tolerance is accomplished.

Although step 340 may be accomplished in a variety of fashions, in one exemplary example it is performed by adjusting the number of conical spring washers stacked in parallel on each plunger element to maintain a centralizing force on the engine casing 350. The step is further performed by adjusting the number of conical spring washers stacked in series on each plunger element to allow each plunger to maintain contact with the engine casing between a maximum spacing gap and a minimum spacing gap, wherein the spacing gap moves between the maximum spacing gap and the minimum spacing gap in response to thermal expansion of the engine casing 360. It should be understood that the precise arrangement conical spring washers in parallel, series, or a combination parallel and series may be configured in a variety of fashions in response to design and performance considerations.

It will be appreciated that the aforementioned method and devices may be modified to have some components and steps removed, or may have additional components and steps added, all of which are deemed to be within the spirit of the present disclosure. Even though the present disclosure has been described in detail with reference to specific embodiments, it will be appreciated that the various modifications and changes can be made to these embodiments without departing from the scope of the present disclosure as set forth in the claims. The specification and the drawings are to be regarded as an illustrative thought instead of merely restrictive thought.

What is claimed is:

1. A centralizing assembly for an engine having a plurality of rotatable vanes, the assembly comprising:

an engine casing;

at least one unison ring disposed concentrically with the engine casing, wherein a spacing gap is formed between the at least one unison ring and the engine casing, the spacing gap variable between a maximum spacing gap and a minimum spacing gap in response to thermal expansion of the engine casing; and one or more centralizer elements comprising:

a plunger element movably mounted to the at least one unison ring and spanning the spacing gap; and at least one spring mounted to the plunger element, the at least one spring exerting a centralizing force through the plunger element onto the engine casing, the at least one spring maintaining the centralizing force between the maximum spacing gap and the minimum spacing gap; and a retaining element position on the exterior surface of the unison ring, the at least one spring positioned between the retaining element and the exterior surface.

2. The centralizing assembly as claimed in claim 1, wherein the at least one spring comprises:

a plurality of conical spring washers stacked in parallel combining to generate the centralizing force.

3. The centralizing assembly as claimed in claim 1, wherein the at least one spring comprises:

a plurality of conical spring washers stacked in series combining to allow the plunger element to travel between the maximum spacing gap and the minimum spacing gap.

4. The centralizing assembly as claimed in claim 1, wherein the at least one spring comprises:

a plurality of conical spring washers stacked in parallel combining to generate the centralizing force; and a plurality of conical spring washers stacked in series combining to allow the plunger element to travel between the maximum spacing gap and the minimum spacing gap.

5. The centralizing assembly as claimed in claim 1, wherein the plunger element includes a plunger tip, the plunger tip remaining in direct contact with the engine casing between the maximum spacing gap and the minimum spacing gap.

6. The centralizing assembly as claimed in claim 1, wherein the spring comprises a Bellville type washer.

7. The centralizing assembly as claimed in claim 1, wherein the one or more centralizer elements comprises:

at least three centralizer elements positioned symmetrically around the unison ring, each of the centralizer element comprising a plurality of springs;

wherein the number of springs on each of the centralizer elements is configured to maintain the unison ring centrally around the engine casing.

8. The centralizing assembly as claimed in claim 1, wherein the plunger element includes a plunger tip configured to slidably engage the engine casing.

9. A method of centralizing a unison ring around an engine casing comprising:

mounting a plurality of centralizer elements around the unison ring, each centralizer element comprising a plunger element movably mounted to the unison ring, a plurality of spring washers mounted to the plunger element, and positioning a retaining element on the exterior surface of the unison ring such that the plurality of spring washers are positioned between the retaining element and the exterior of the unison ring, wherein the plunger element spans a spacing gap between the unison ring and the engine casing;

adjusting the number of spring washers on each plunger element such that the unison ring is centralized around the engine casing.

10. The method of centralizing the unison ring as claimed in claim 9, wherein the spring washers comprise Bellville type washers.

11. The method of centralizing the unison ring as claimed in claim 9, further comprising:

adjusting the number of spring washers stacked in parallel on each plunger element to maintain a centralizing force on the engine casing.

12. The method of centralizing the unison ring as claimed in claim 9, further comprising:

adjusting the number of spring washers stacked in series on each plunger element to allow each plunger to maintain contact with the engine casing between a maximum spacing gap and a minimum spacing gap, wherein the spacing gap moves between the maximum spacing gap and the minimum spacing gap in response to thermal expansion of the engine casing.

13. The method of centralizing the unison ring as claimed in claim 9, wherein the number of spring washers on each plunger element is adjusted to accommodate for an asymmetrical unison ring.

14. The method of centralizing the unison ring as claimed in claim 9, wherein the number of spring washers on each plunger element is adjusted to accommodate for thermal expansion characteristics and dimensional tolerance characteristics of the unison ring and the engine casing.

15. A method of centralizing a unison ring around an engine casing comprising:

determining the thermal expansion characteristics of an engine casing;

determining the dimensional tolerance characteristics of the unison ring positioned around the engine casing;

mounting a plurality of centralizer elements around the unison ring, each centralizer element comprising a plunger element movably mounted to the unison ring and a plurality of biasing members mounted to the plunger element, wherein each plunger element spans a spacing gap between the unison ring and the engine casing and exerts a centralizing force on the engine casing;

individually adjusting the number of biasing members on each plunger element to accommodate the thermal expansion characteristics and the dimensional tolerance characteristics such that the unison ring is centralized around the engine casing between a maximum spacing gap and a minimum spacing gap; and positioning a retaining element on the exterior surface of the unison ring, the plurality of biasing members positioned between the retaining element and the exterior surface.

16. The method of centralizing the unison ring as claimed in claim 15, further comprising:

adjusting the number of biasing members stacked in parallel on each plunger to maintain the centralizing force on the engine casing.

17. The method of centralizing the unison ring as claimed in claim 15, further comprising:

adjusting the number of biasing members stacked in series on each plunger such that each plunger maintains contact with the engine casing between the maximum spacing gap and the minimum spacing gap.

18. The method of centralizing the unison ring as claimed in claim 15, further comprising:

adjusting the number of biasing members stacked in series on each plunger to accommodate dimensional variances of the unison ring.

* * * * *